United States Patent [19]

Matte

[11] 4,315,593

[45] Feb. 16, 1982

[54] DEVICE FOR CENTRIFUGING LIQUIDS CONTAINING PARTICLES OR CELLS IN SUSPENSION

[75] Inventor: Claude Matte, Paris, France

[73] Assignee: Centre National de Transfusion Sanguine, Paris, France

[21] Appl. No.: 14,092

[22] Filed: Feb. 22, 1979

[30] Foreign Application Priority Data

Mar. 1, 1978 [FR] France ..... 78 05899

[51] Int. Cl.[3] ..... B04B 11/04

[52] U.S. Cl. ..... 233/21; 233/26

[58] Field of Search ..... 233/3, 1 E, 5, 23 R, 233/26, 27; 356/246, 21

[56] References Cited

U.S. PATENT DOCUMENTS

| | | | |
|---|---|---|---|
| 3,291,693 | 12/1966 | Brown | 233/26 X |
| 3,582,285 | 6/1971 | Hamilton | 356/246 X |
| 3,848,796 | 11/1974 | Bull | 233/26 X |
| 3,905,772 | 9/1975 | Hartnett et al. | 233/26 X |
| 4,052,161 | 10/1977 | Atwood et al. | 356/246 X |

FOREIGN PATENT DOCUMENTS

| | | |
|---|---|---|
| 2414380 | of 0000 | Fed. Rep. of Germany . |
| 2619487 | of 0000 | Fed. Rep. of Germany . |
| 1115297 | 5/1968 | United Kingdom . |
| 1404120 | 8/1975 | United Kingdom . |
| 1478620 | 7/1977 | United Kingdom . |
| 1512685 | 6/1978 | United Kingdom . |
| 1524726 | 9/1978 | United Kingdom . |

OTHER PUBLICATIONS

Physik, 1960, pp. 65–69.
"Minizentrifuge", Compur M1100.
"Ultrazentrifugen", 1951, pp. 736–741.
Cooke Microtiter (1971?).
German Patent Appln. (?) 7223415 Sep. 21, 1972.

*Primary Examiner*—Edward L. Roberts
*Attorney, Agent, or Firm*—Larson and Taylor

[57] ABSTRACT

A device for centrifuging liquid, inter alia for collecting particles or cells in suspension in the liquid. It comprises a vessel for the liquid to be centrifuged made of a material, for example PVC, such that the liquid sample is held inside it by electrostatic forces of attraction and/or by surface tension forces, even when the vessel is not rotating and its orifice is facing downwards.

26 Claims, 10 Drawing Figures

III
II
6
66
46
5
52
56
3a
21
22
6₂
6₁
60
47
27
4
62
58
59
26₆
26₅
26₄
26₃
26₂
26₁
3
61
72a
64
65
63
72
2
3b
1a
53
8
1
7a
16b
7
71
70
20
75
20
73
9
10
74
11
12
III

DEVICE FOR CENTRIFUGING LIQUIDS CONTAINING PARTICLES OR CELLS IN SUSPENSION

The invention relates to a device for centrifuging liquids and a means for analyzing or processing sets of liquid samples and comprising an aforementioned device. More particularly, the invention relates to a device for centrifuging liquids containing particles or cells in suspension.

A known device for centrifuging liquids comprises a vertical shaft secured to arms holding vessels adapted to contain liquids to be centrifuged. The vessels, at least when the shaft is not rotating, must have an aperture facing upwards so that they can be filled with liquid to be centrifuged. The need for the axis of rotation and the vessels to be in a given direction may be disadvantageous in certain applications.

One object of the invention is to provide a liquid-centrifuging device which is free from the need for a vertical axis of rotation.

Another object is to construct a centrifuging device which is particularly simple and economic.

The centrifuging device according to the invention is characterised in that the vessel for holding the liquid to be centrifuged has a shape and is made of a material such that the liquid therein is kept inside it by the action of electrostatic forces even if the vessel is not rotating and its orifice is facing downwards. As a result, the vessel can be disposed in an invariable position relative to the axis of rotation. This invariable position is the position for centrifuging, i.e. at which the free surface of the liquid in the vessel faces the axis of rotation. The axis of rotation may be in any direction but is preferably horizontal.

Preferably, the edge of the orifice is continued, at an angle to the vessel wall and outside it, by a collar or the like in one piece with the rest of the vessel, and the edge between the collar and the vessel is sharp or has a small radius of curvature.

According to another feature of the invention, the same result (i.e. of holding or retaining the liquid in the vessel) can be obtained by using a vessel having a shape and made of material such that the liquid sample therein is kept inside it by the action of surface tension forces, even when the vessel is not rotating and its orifice is facing downwards.

Alternatively, the vessel can have a shape and be made of a material such that the liquid is held in the vessel by both surface tension and electrostatic attraction forces. This occurs, when for instance, the vessel is at least partly cylindrical and has a diameter between 1 and 7 mm and the material is a plastic such as polyvinyl chloride (PVC).

Preferably the device comprises means for holding the vessels in an invariable position relative to the axis of rotation. In one embodiment the device comprises a hollow cylindrical drum, vessels adapted to be secured to the inner drum wall so that their apertures face the drum axis, and means for driving the drum in rotation around its axis.

According to another feature of the invention, the centrifuging device comprises two superposed sets of vessels having apertures for insertion of liquid facing the axis of rotation. Each vessel in the first set corresponds to a vessel in the second set disposed along the same radial line relative to the axis of rotation but nearer the aforementioned axis. The vessels in the second set all have a perforated bottom opposite the insertion aperture of the corresponding vessel in the first set. By means of the aforementioned device, a liquid (e.g. a reagent) can be transferred by centrifuging simultaneously from all the vessels in the second set to all the corresponding vessels in the first set.

In one embodiment of a centrifuging device comprising one or two sets of vessels, the vessels in each set are divided into groups each containing the same number of vessels, and the edges of the apertures of the vessels in each group are secured to a flexible plate (which can form the aforementioned collar) and has at least two parallel edges. In the last-mentioned embodiment, the drum has sectional members secured to its inner wall, extending parallel to its axis, regularly distributed around its axis and forming means for receiving the edges of the flexible plates such that when the edge of a plate are received in two adjacent sectional members, the bottoms of the vessels secured to the plate are pressed against the inner wall of the drum. As a result, the flexible plate follows the general shape of the part of the inner drum wall between two sectional members.

A centrifuging device of the aforementioned kind advantageously forms part of a means for analyzing and/or processing sets of liquid samples, the means also comprising a disc adapted to rotate around its vertical axis and having a ring bearing vessels for the sets of liquid samples. Each set is made up of a number n of samples, and therefore the vessels in the ring are divided into groups of n vessels. In one embodiment, each group of vessels is distributed along an involute of a circle.

Preferably, the vessels secured to the inner surface of the drum in the centrifuge device are disposed along lines parallel to the centrifuge axis and at regular intervals around the axis. The number of vessels along each line is at least n. In that case, the device also comprises means whereby the n samples in a single group disposed in n vessels on the disc of the processing means are simultaneously transferred to the corresponding n vessels aligned along a drum generatrix and vice versa.

Other aims, features and advantages of the invention will be clear from the following description of some embodiments thereof, the description referring to the accompanying drawings in which.

Figure 1:
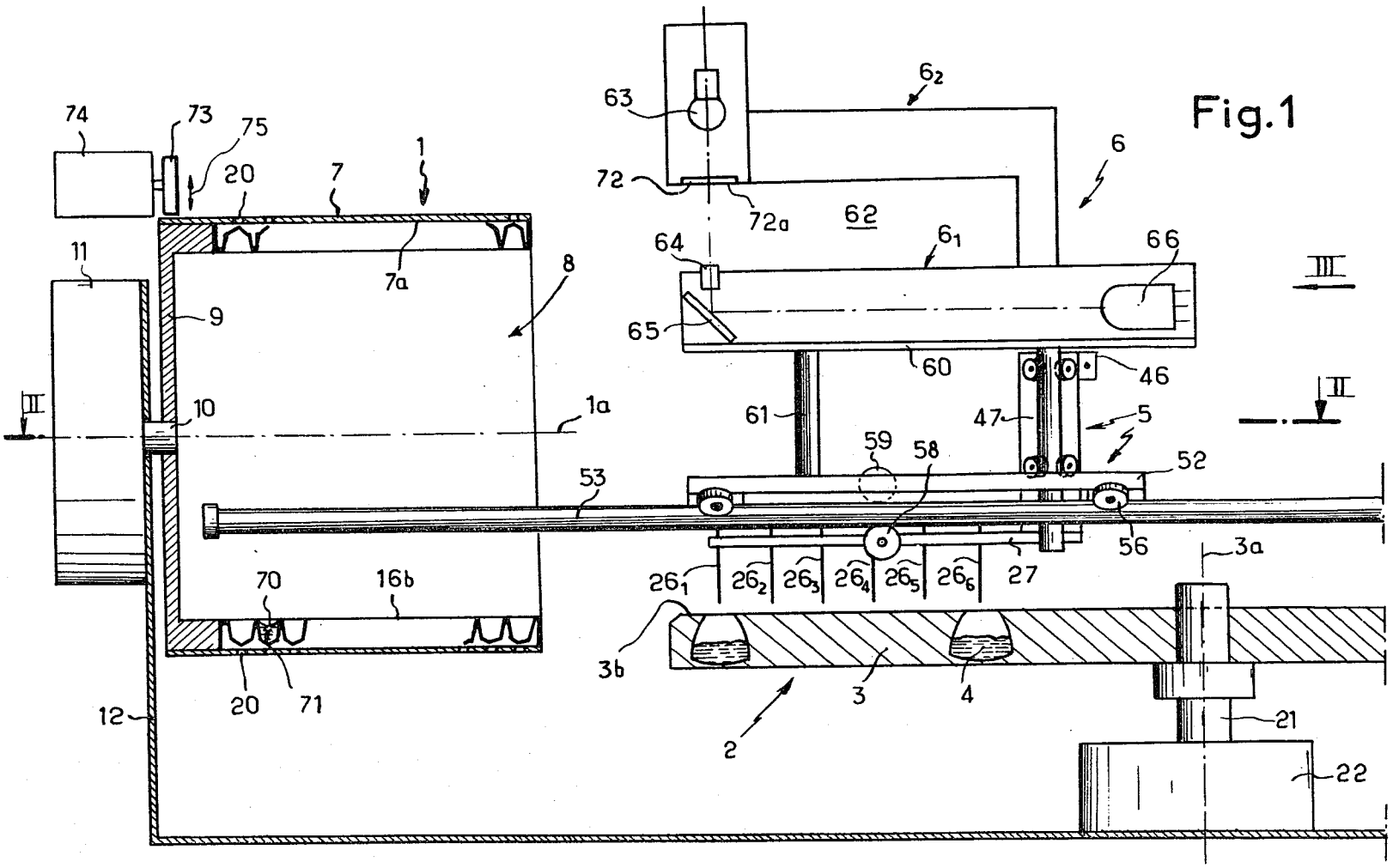
FIG. 1 is a diagrammatic general view of a device for analyzing sets of liquid samples according to the invention.

The device shown in FIGS. 1-6 comprises (FIG. 1) a centrifuge 1, a device 2 comprising a rotary disc 3 bearing vessels 4 containing liquid samples, and a slide 5 adapted to transfer liquid samples from vessels 4 to vessels in centrifuge 1 and also adapted to bear a device 6 for optically analyzing the samples in centrifuge 1, after the samples have been processed.

The device is automatically operated by control means (not shown).

Centrifuge 1 comprises a cylindrical drum 7 having a horizontal axis 1*a*. The drum is open at one end 8 so that slide 5 can enter, at least partly. The other end of drum 7 is closed by a plate 9 secured to the outlet shaft 10, coaxial with drum 7, of an electric motor 11 adapted to rotate drum 7 at high speed around axis 1*a* for centrifuging. The assembly comprising motor 11 and drum 7 is secured to a frame 12.

Drum 7 can also be rotated step-by-step at low speed by an assembly comprising an electric motor 74 and a roller 73. The roller is secured to the shaft of motor 74 and the assembly cooperates with coupling means (not shown) whereby roller 73 can be pressed against the outer surface of drum 7 when required. The shaft of motor 74 is horizontal, i.e. parallel to axis 1*a*, and the coupling means can be used to move roller 73 in the direction represented by the double arrow 75, i.e. perpendicular to axis 1*a*. Roller 73 cooperates with part of the periphery of drum 7 at a place where there are no vessels. In the example, the part in question is near plate 9.

The aforementioned coupling means are actuated by coder means (not shown) comprising, for example, a coder wheel keyed to shaft 10 and in the form of a disc having apertures distributed around a circle centred on axis 1*a*, the positions of the apertures corresponding to those of the lines of vessels parallel to the axis, as will be shown hereinafter in connection with FIG. 3. A light source and a light-detecting element in fixed positions are disposed on opposite sides of the coder wheel. The source is in a position such that it can transmit a light beam through an aperture in the coder wheel, and the detector element is disposed at a place such that it can detect the light beam emitted by the source and travelling through an aperture in the coder wheel. The detector element is associated with means for moving the assembly comprising motor 74 and roller 73 in the direction of arrow 75.

When certain conditions are fulfilled (as explained hereinafter) the control means for automatically actuating the device are used to press roller 73 again against the periphery of drum 7.

Six substantially T-shaped sectional members $13_1$, $13_2$ . . . $13_6$ (FIG. 3) are secured to the inner surface of drum 7 and extend longitudinally parallel to axis 1*a*. The members are disposed at regular intervals around the axis; i.e. the angle at the centre between two adjacent members is 60°. In the case of each member (e.g. $13_1$) the major limb 14 of the T extends radially inside the drum, and the top limb 15 faces the inner surface 7*a* of the drum so as to leave a space between limb 15 and surface 7*a*.

Plates 16 are disposed between each pair of adjacent sectional members and vessels or cups 17 are formed in the plates and have a conical bottom 18. Plates 16 and cups 17 are made of transparent plastic such as polyvinyl chloride, which is flexible and resilient. When the plates are not inserted between two adjacent sectional members in drum 7, they are substantially flat. The shape and dimensions of cups 17 are such that when plate 16 is disposed between two adjacent sectional members in drum 7 so that the edges of its top surface 16*a* press against the bottom surface of the respective limbs 15, the apices 19 of the conical bottoms 18 of cups 17 press against the inner surface 7*a* of drum 7.

Each plate 16 is substantially rectangular and the cups 17 are disposed in parallel lines at the edges of the plates so that the lines are parallel to axis 1*a* when plates 16 are inserted into the drum in the manner shown in the drawing. In the example, twelve cups 17 are disposed in each line.

The plates are inserted into drum 7 by sliding them through the aperture in drum 7 under the bottom surfaces of limbs 15 of two adjacent sectional members 13. After being inserted into drum 7, the plates follow the cylindrical shape of the drum.

For the purpose of optical analysis of the liquid samples after they have been processed in cups 17, drum 7 has a set of apertures 20 at places corresponding to the bottoms 18 of cups 17. Alternatively, instead of having the aforementioned apertures, the drum is transparent, at least at the aforementioned places.

The disc 3 of device 2 extends substantially in a horizontal plane and can be driven stepwise in rotation around its vertical axis 3*a* by the shaft 21 of a step-by-step electric motor 22. Device 2 is also secured to frame 12.

The top surface 3*b* of disc 3 is substantially in the same horizontal plane as the lowest generatrix 16*b* (FIG. 1) of the cylinder formed by the plates 16 inserted into drum 7.

Vessels 4 (FIG. 4) are distributed in disc 3 and are divided into groups $24_1$, $24_2$, etc. In each group (e.g. $24_1$), vessels $4_1$, $4_2$ . . . $4_6$ are disposed so that their axes are on a curve 25 which is an involute of a circle.

As we shall show hereinafter, each group $24_1$, $24_2$ etc. is associated with a corresponding group of cups 17 in centrifuge 1.

Slide 5 bears six hollow needles or probes $26_1$, $26_2$ . . . $26_6$ which normally extend vertically and are adapted to suck up the liquid samples in each group of vessels $4_1$ . . . $4_6$ on disc 3, in order to insert them into the corresponding group of cups on centrifuge 1. Accordingly, each needle 26 is associated with the pipe system 200 of a suction and delivery peristaltic pump 201.

In the example, the hollow needles 26 are made of stainless steel. Their inner duct (not shown) is carefully polished and the hollow needles are short—a few centimeters in length.

The hollow needles $26_3$ and $26_4$ are secured to a horizontal plate 27 (FIGS. 2 and 5) bearing sectors 28, 29 pivoting around vertical axes $28_1$ and $29_1$ respectively. The pivoting sector 28 bears needles $26_1$ and $26_2$ whereas sector 29 bears needles $26_5$ and $26_6$. Needles $26_1$, $26_2$, $26_5$ and $26_6$ extend through plate 27 via apertures $30_1$, $30_2$ $30_5$ and $30_6$ respectively.

Sector 28 bears a vertical stud 31 at one corner, and likewise sector 29 has a vertical stud 32 at one corner.

Studs 31 and 32 are adapted to co-operate with slopes 33 and 34 at fixed positions in the frame of the device. Slope 33 is oblique relative to axis 1*a* and is disposed near aperture 8 of drum 7, whereas slope 34, which extends parallel to slope 33, is disposed outside drum 7.

Slope 34 is prolonged, in the direction opposite from drum 7, by a guide slot 35 (FIG. 2) parallel to axis 1*a*.

The oblique slope 33 is prolonged, towards the interior of drum 7, by a slope 37 parallel to axis 1*a*.

Figure 2:
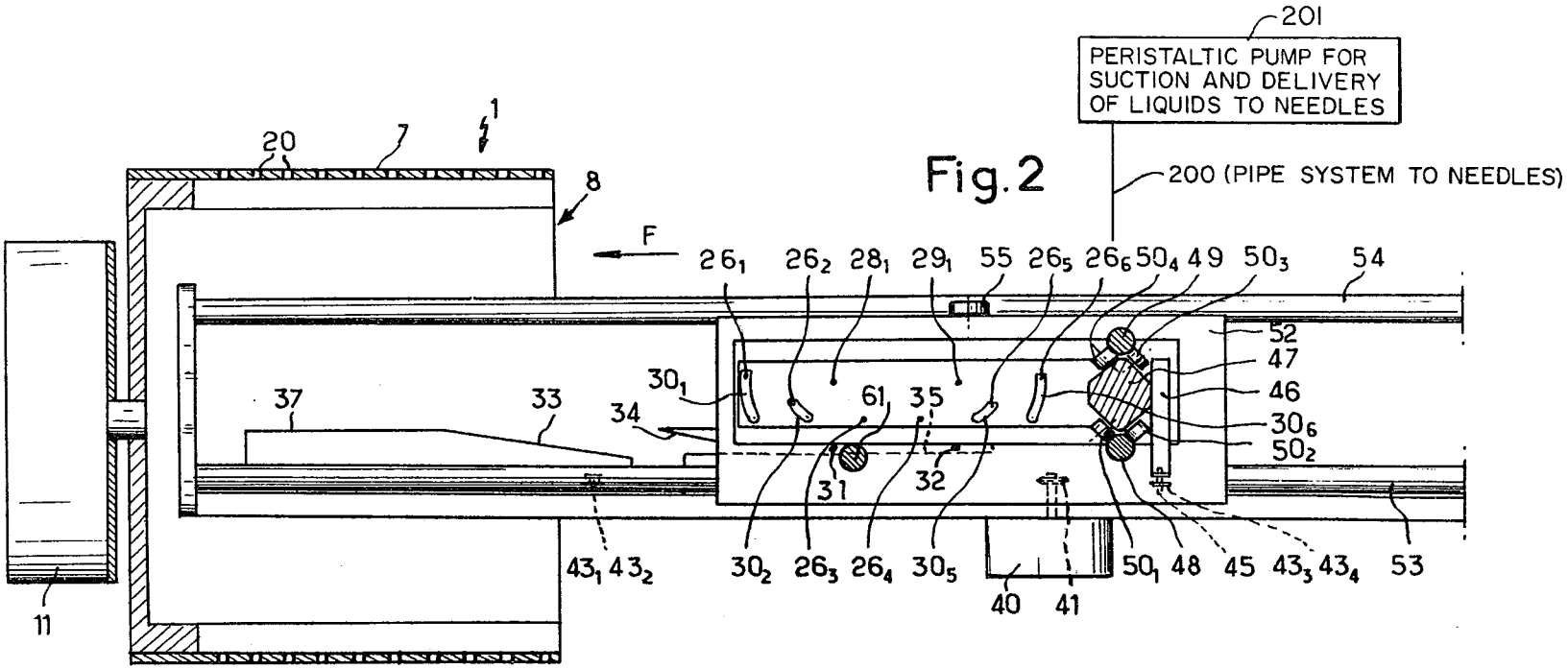
FIG. 2 is a view along line II—II of the device shown in FIG. 1.
Figure 4:
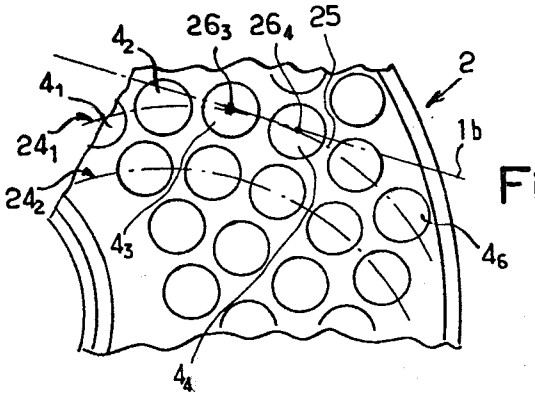
FIG. 4 is a partial plan view of part of the device shown in FIG. 1.

The assembly comprising the pivoting sectors 28, 29, the slopes 33, 34, 37 and the slot 35 is adapted to modify the arrangement or relative positions of the hollow needles 26 when slide 5 moves from a first position (where the needles are opposite vessels 4) to a second position (where the needles are opposite cups 17) and vice versa. In the first position, the hollow needles are distributed (in horizontal projection) along a curved line forming an involute of a circle (line 25, FIG. 4) as shown in FIG. 2. In the first position also, each needle is disposed above the orifice of a vessel in one group, e.g. group $24_1$; thus, as shown in FIG. 4, needles $26_3$ and $26_4$ are above the orifices of vessels $4_3$ and $4_4$ respectively. In this position, the line 1*b* joining the centres of vessels $4_3$ and $4_4$ is parallel to and in the same vertical plane as axis 1*a*.

Figure 5:
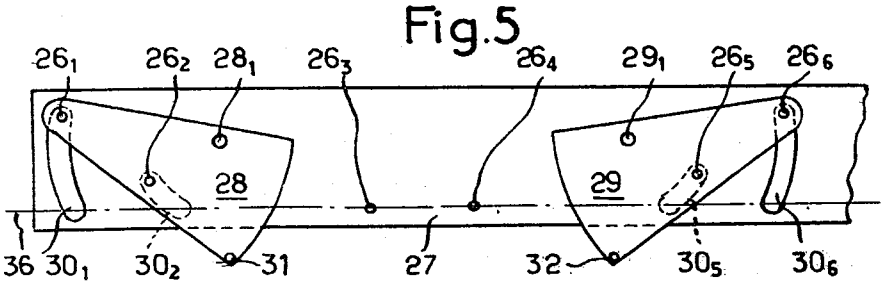
FIG. 5 shows another part of the device in FIG. 1.

In the second position the needles (in horizontal projection) are aligned (line 36 in FIG. 5).

When needles 26 are disposed above disc 3, studs 31 and 32 are in slot 35 parallel to axis 1*a* (FIG. 2). When slide 5 moves in the direction of arrow F towards drum 7, studs 31 and 32 slide on slope 33 and reach slope 34 parallel to axis 1*a*. In this position, the needles are in a straight line (lines 36).

When guide 5 moves in the opposite direction to arrow F and returns to its first position (when the needles are disposed above vessels 4 on disc 3), studs 31 and 32 slide against the oblique slope 34 and are inserted into slot 35.

In addition to the needles 26 and associated bearing means, slide 5 comprises means for vertically moving the needles 26. Means are also provided for moving the slide horizontally parallel to axis 1*a*.

Figure 3:
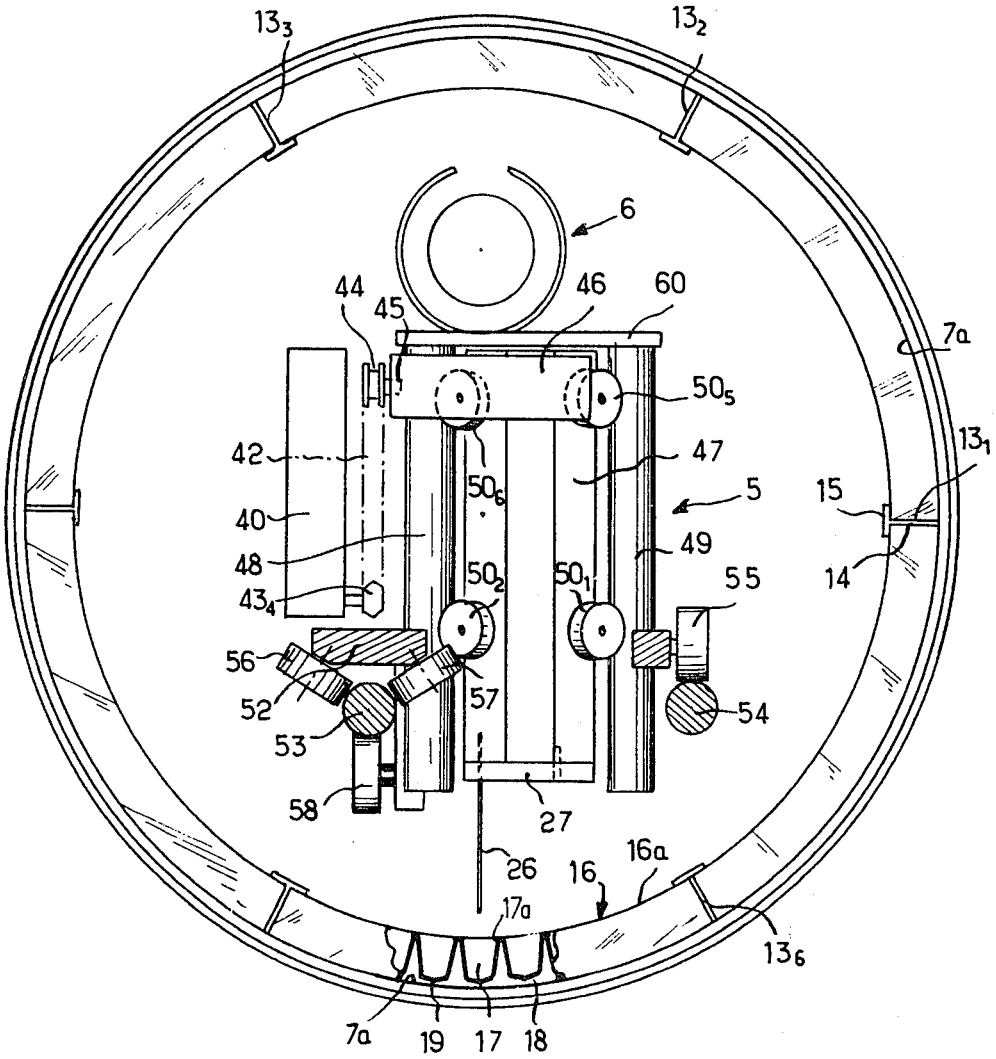
FIG. 3 is a view along arrow III of the device shown in FIG. 1.
Figure 6:
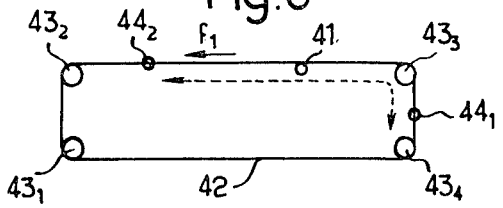
FIG. 6 shows the operation of part of the device according to the invention shown in FIG. 1.

All these movements are brought about by a motor unit 40 driving a toothed wheel 41 which drives an endless chain 42 (FIGS. 3 and 6). The chain extends over pulleys secured to the frame of the device. Two pulleys $43_1$, $43_2$ are on the same vertical line near aperture 8, whereas the other two pulleys $43_3$, $43_4$ are on the same vertical line but near disc 3.

The positions of pulleys $43_1 \ldots 43_4$ can be modified so as to vary the tension on chain 42.

One link 44 of chain 42 bears a shaft 45 (FIG. 3) secured to a horizontal bar 46 which is in the transverse direction relative to axis 1*a* and is vertically movable on slide 5. Bar 46 is secured to a vertical bar 47 which is substantially hexagonal in horizontal section (FIG. 2). The plate 27 bearing the hollow needles 26 is secured to the bottom of bar 47. Bar 47 can slide vertically; to this end, the slide comprises two cylindrical uprights 48, 49 between which bar 47 is disposed. Bar 47 is also secured to rollers $50_1$, $50_2 \ldots 50_8$ which can rotate freely around horizontal axes and press against uprights 48 and 49.

Uprights 48 and 49 are secured to a horizontal platform 52 forming part of slide 5. Platform 52 is adapted to slide on horizontal bars 53, 54 parallel to axis 1*a*. To this end, platform 52 rests on bar 54 via an axially horizontal roller 55 (FIG. 3) and rests on bar 53 via rollers 56 and 57 having axes in a vertical plane but in an oblique direction relative to the vertical. Slide 5 also has two axially horizontal rollers 58, 59 disposed one below and one above bar 53 (FIGS. 1 and 3). By means of rollers 56, 57, 58 and 59, slide 5 can be actuated via guide bars 53 and 54.

FIG. 6 is a reduced-scale diagram showing how chain 42, which extends around pulleys $43_1$, $43_2$, $43_3$ and $43_4$, controls the vertical and horizontal movements of the hollow needles 26. When needles 26 are lowered into vessels $4_1 \ldots 4_6$ in group $24_1$ (FIG. 4), link 44 of chain 42 is in position $44_1$. In order to raise the hollow needles and move the slide in the direction of arrow F (FIG. 2), chain 42 is driven in the direction of arrow $f_1$. When link 44 travels along the line between position $44_1$ and pulley $43_3$, plate 27 is raised but slide 5 does not move horizontally. After link 44 has moved beyond pulley $43_3$, needles 26 have been detached from vessels 4. Thereafter, link 44 moves in the direction of arrow $f_1$ beyond pulley $43_3$. Under these conditions, bar 46 is acted upon only in the horizontal direction and consequently slide 5 moves in the direction of arrow F. An abutment (not shown) stops the slide when needles 26 are above the corresponding cups in centrifuge 1. In this position, link 44 is at the plane $44_2$.

Alternatively, a belt is used instead of chain 42.

Uprights 48, 49 are surmounted by a horizontal plate 60 (FIG. 1) borne by a third cylindrical upright 61 secured to platform 52 of slide 5.

Plate 60 bears the optical analysis device 6. Device 6 has two parts or sections $6_1$ and $6_2$ separated by a space 62. The top part $6_2$ has a light source 63 and a diffusing plate 72 below the source, whereas the bottom part $6_1$ has a lens 64 opposite plate 72. The lens 64 has a short focal length (a few centimeters) and a mirror 65 is disposed underneath it and inclined 45° to the horizontal. Part $6_1$ also comprises an image-analyzing tube 66, e.g. a vidicon tube, for electrically scanning the image sent by mirror 65. Scanning is carried out in two dimensions according to the invention.

Portion $6_2$ of device 6 is disposed above the horizontal plane containing the top generatrix of drum 7, whereas portion $6_1$ is disposed below the top generatrix of the cylinder formed by the outer surfaces 16*a* of plates 16. Consequently, when slide 5 is in its second position (i.e. the position where needles 26 are opposite cup 17), the light beam emitted by source 63 travels successively through an aperture 20 on a top generatrix of the drum, the bottom 18 of a cup 17 pressed against aperture 20, and the contents of the liquid in the cup, after which the beam reaches lens 64 and is reflected towards tube 66 by mirror 65.

Plate 72 is a diffusing plate without grain, e.g. an "opaline" plate. Its diameter is appreciably greater than that of a cup 17, e.g. four times the cup diameter. Portion $6_2$ is disposed so that the lower surface 12*a* of plate 72 is almost in contact with the outer periphery of drum 7, so that the distance between plate 72 and the bottom of cup 17 is at a minimum when slide 5 is inserted into drum 7. As a result of these features, the light beam travelling through the cups is diffused, so that apex 19 does not form a shadow to be detected by tube 66, since the apparatus associated with tube 66 would interpret such a shadow as an analytical result, which would completely distort the results.

Slide 5 also bears a set of twelve hollow probes or needles (not shown) each associated with the pipe system of a peristaltic pump. The probes are axially vertical and, in horizontal projection, are aligned parallel to axis 1*a* in order to inject reagents into a row of twelve cups 17. The device according to the invention is advantageously used for working the method according to copending application. "A method of detecting or identifying virus antigens, erythrocyte or cell antigens or antibodies in a biological medium". We shall therefore, by way of example, describe the use of the device for determining the rhesus group of a sample of human blood, i.e. for determining the presence (positive rhesus) or absence (negative rhesus) on erythrocytes of antigen radicals having a specific action D.

In this application, each vessel 4 contains about 400 microliters of a liquid containing a suspension of erythrocytes which have previously been incubated in the presence of an anti-D human test serum containing type G immunoglobulins (IgG) having inter alia a specific anti-D antibody function, i.e. capable of becoming fixed to any D-antigen radicals carried by the erythrocyte. After being incubated, the erythrocytes have also been "washed" in order to remove any immunoglobulins which have not become fixed on the erythrocytes. In addition, human IgG molecules are fixed (e.g. by adsorption) on to the conical bottoms 18 of cups 17.

The operations mentioned in the previous paragraph are preferably carried out by using the device sold under the Trade-Mark "GROUPAMATIC" by the Company styled "ROCHE BIOELECTRONIQUE".

The contents of vessels in group $24_1$ are sucked by the pipe systems of a peristaltic pump (not shown) through the corresponding hollow needles $26_1 \ldots 26_6$. The needles are then raised and slide 5 is moved in the direction of arrow F so that the needles come vertically into line with the corresponding cups 17, which are disposed in a straight line parallel to axis 1*a*. A group of six vessels 4 are associated with two groups of cups 17 on the same horizontal line; the contents of each vessel 4 is distributed between two corresponding cups 17. Accordingly, the peristaltic pump associated with each hollow needle injects 50 microliters of its contents into a cup 17, after which slide 5 is moved (parallel to axis 1*a*) until the hollow needles are above the adjacent group of cups in the drum, when each peristaltic pump injects 50 microliters of liquid into each cup in the second group. Each suspension of erythrocytes is divided between two cups in order to test it against two different reagents or against a single reagent in two different concentrations.

After the erythrocyte suspensions have been transferred, the slide is moved in the direction opposite to arrow F and disc 3 is rotated one step so that, after the slide has returned, needles 26 are vertically in line with group $24_2$ (FIG. 4). While slide 5 is in the last-mentioned position above disc 3, drum 7 is rotated by motor 74 and roller 73, so that a new line of cups 17 takes the place of the line of cups which has just been filled.

Erythrocyte suspensions are transferred from vessels 4 to cups 17 until all the cups in drum 7 have been filled with the suspensions.

It is not necessary to clean the hollow needles 26 between each pair of transfers, since experiments made as part of the invention have shown that the first fractions of a sample of erythrocyte suspension progressively clean (or "rinse") the traces of samples previously transferred by the same hollow needle. Since the hollow needles are short and carefully polished within, the very first fractions are sufficient to clean the duct in the needles. The first fractions (i.e. the cleaning or rinsing fraction) are of 300 microliters in the present example. Accordingly, a 400-microliter sample from a vessel 4 is used as follows: 300 microliters for cleaning the hollow needle (i.e. this part of the sample is not analysed), 50 microliters for a cup 17 and 50 microliters for a second cup 17.

In the application under consideration, rinsing is additionally facilitated since the red corpuscles are easy to entrain because they are not absorbed by the metal surface of the needle.

The volumes of cups 17 and the amounts of liquid introduced thereinto are such that the free surface 70 (FIG. 1) of liquid 71 forms a concave meniscus and thus cannot escape from cup 17, irrespective of the direction of the cup relative to the vertical. However, to obtain this result (i.e. the liquid being kept in cup 17 irrespective of its position), the cup 17 must first be cleaned and carefully dried.

With regard to the dimensions of cup 17 it has been found that liquid is retained in the cup under good conditions if the cup is made of polyvinyl chloride, its diameter is between 1 and 7 mm, preferably between 3 and 6 mm, and the volume of liquid introduced into the cup is between 15 and 250 microliters.

It is thought that this result (i.e. that liquid 71 is kept in cup 17 irrespective of the position of the cup, and a concave meniscus is obtained even though the cups are made of PVC having low wettability) is mainly due to a combination of electrostatic attraction and repulsion between the hydrous contents of the cups and the insulating material of which the cups are made, depending on the local geometry of the material.

Without wishing to limit the invention to a particular theory, it is thought that repulsion occurs when the plastic forming the cup has a projecting angle (edge 17*a*) whereas electrostatic attraction will be increased in re-entrant angles (i.e. if cup 17 has inner edges).

With regard to this last point, experiments made as part of the invention have shown that edge 17*a* repels the liquid whereas the rest of the vessel or plate 16 attracts the liquid. As we shall show hereinafter, the jet of liquid introduced into cup 17 must be given sufficient kinetic energy to overcome the repulsion of edge 17*a*. However, once the liquid has been introduced into the vessel, the repulsion of the edge helps to retain the liquid in the vessel.

It is also possible that the liquid is held in the vessel by surface tension.

After all the cups on drum 7 have been filled, slide 5 is returned to the interior of drum 7 and the additional set of twelve probes associated with twelve respective pipe systems of a peristaltic pump (not shown) and disposed on slide 5 inject a diluted animal immune serum or "antiglobulin" into the cups. The antiglobulin contains, inter alia, molecules having an antibody action against (a) human IgG immunoglobulins having anti-D antibody specificity and with which the erythrocytes have previously been incubated and (b) human IgG immunoglobulins fixed to the bottom 18 of cups 17. About 50 microliters of diluted antiglobulin are injected into each cup. The antiglobulin is injected very quickly, i.e. in a few seconds (5–10 in an example). To this end, drum 7 is continuously rotated while the antiglobulin is inserted in discontinuous jets through the probes when the cups arrive opposite the probes. The injection can be synchronized by known means comprising a coder wheel and a photoelectric detector for controlling the peristaltic pump (this assembly is not shown in the drawings).

Although the diluted antiglobulin should be injected in approx. 5–10 seconds, the incubated erythrocytes can be introduced during a longer period, e.g. of the order of 2–4 minutes.

The pressure in the pipes of the peristaltic pump for injecting the diluted antiglobulin is made sufficient to obtain a good-quality mixture of the erythrocyte suspension with the diluted antiglobulin, and also to prevent the jet of diluted substance from being deflected by electrostatic repulsion due to the charges accumulated by plate 16 and by the edge 17*a* joining cup 17 to plate 16. Peristaltic pumps of the aforementioned kind are e.g. of the escapement kind, i.e. comprise a rotor and a spring tensioned by the rotor during two-thirds of the revolution, and are designed so that the energy is returned to the rotor during the last third of a revolution, when the jet of liquid is sprayed.

After cups 17 have thus been loaded with dilute antiglobulin, drum 7 is kept still for a time of the order of 40 to 160 seconds, duringwhich an antiglobulin incubation reaction occurs.

Next, drum 7 is continuously rotated at high speed for the purpose of centrifuging. During a first step, centrifuging is carried out at an acceleration of approx. 20 g (g being the gravitational acceleration) for 60 seconds; during a second step, centrifuging is carried out at considerably higher acceleration—of the order of 1600 g—for a time of the order of 15 seconds.

After these centrifuging operations, slide 5 is brought inside drum 7 so that device 6 can carry out optical analysis. To this end, the slide makes rapid stepwise movements parallel to axis 1*a* and drum 7 also rotates stepwise so that all the cups 17 are scanned line by line by the light beam from the optical analysis device. Alternatively, the slide, instead of moving rapidly stepwise parallel to axis 1*a*, moves at a constant but lower speed than in the case of stepwise motion.

The images are scanned in two dimensions by a camera comprising a television tube 66, which means that device 6 need not be accurately adjusted after an initial adjustment.

Advantageously, the outlet of the image analyzing tube 66 is connected to the input of a magnetic tape recorder so that the recorded information can be processed, either immediately or subsequently.

Figure 7:
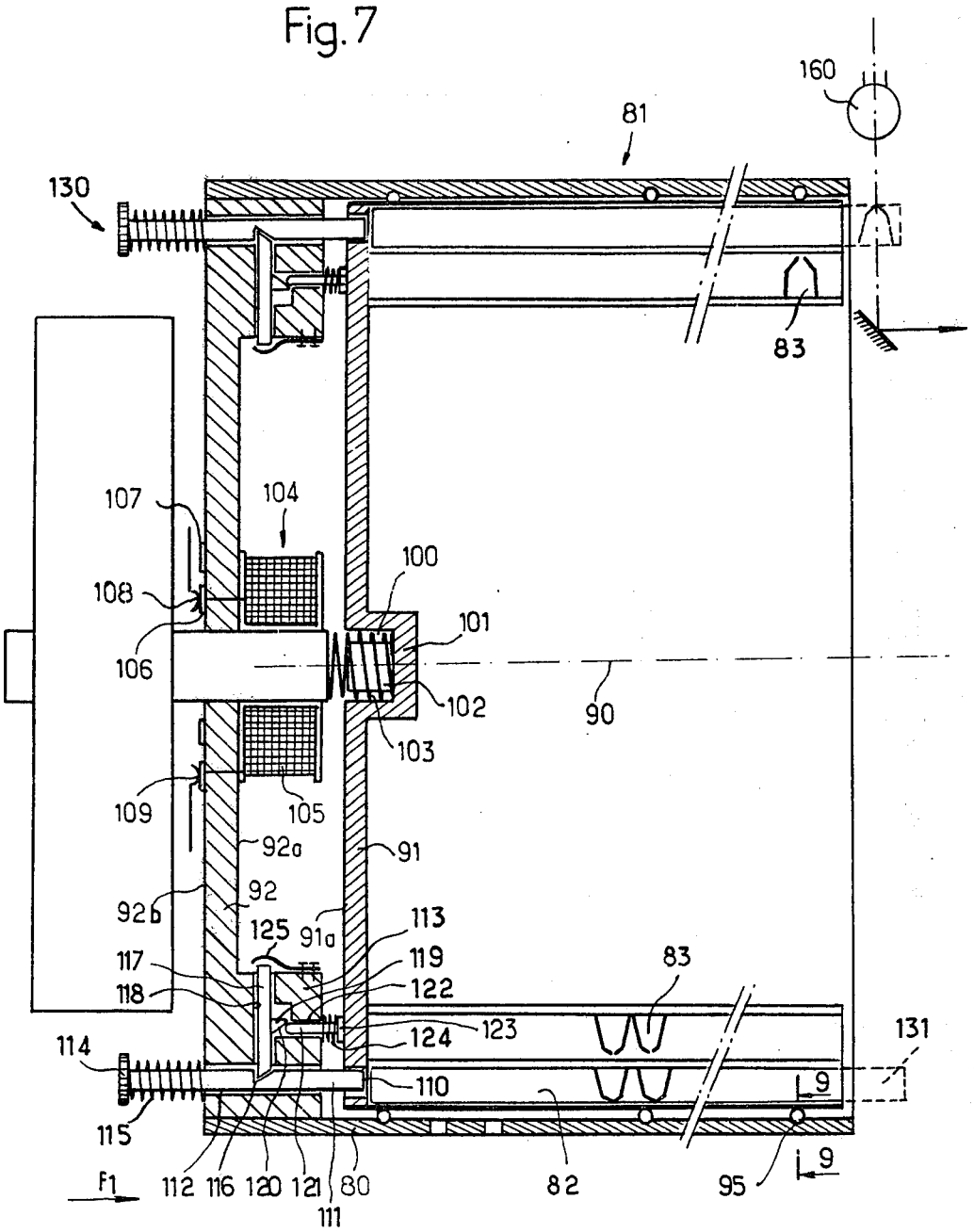
FIG. 7 is a diagrammatic view in vertical section along the drum axis of a centrifuging device according to another embodiment of the invention.
Figures 8, 9:
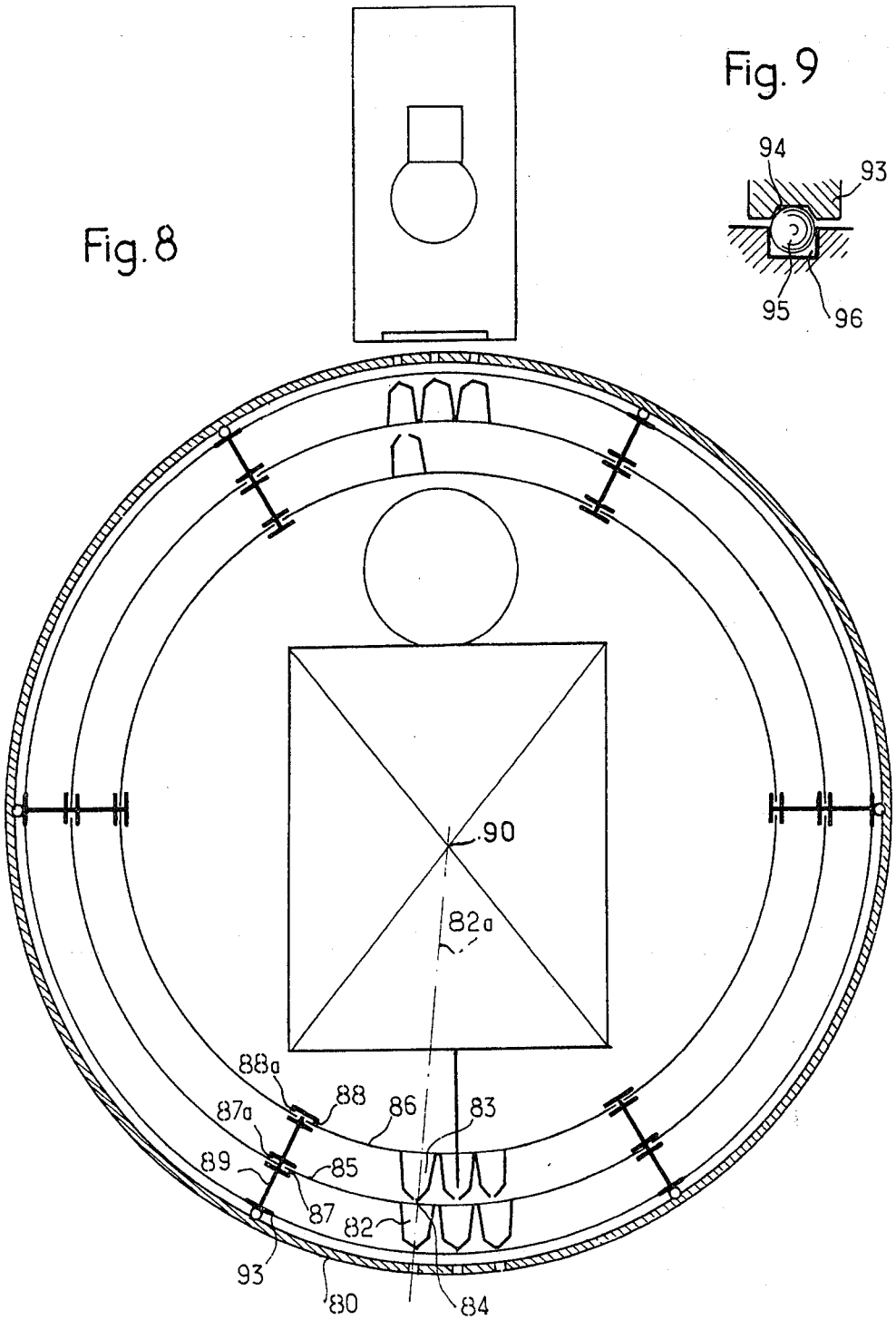
FIG. 8 is a view corresponding to FIG. 3 but simplified, showing a device for analysing sets of liquid samples according to the invention and comprising the centrifuging device illustrated in the FIG. 7.
FIG. 9 is a section along line IX—IX in FIG. 7 but on a larger scale, showing a detail of the device in FIG. 7.

FIGS. 7-9 show a centrifuge device and apparatus which differ in the followings points from the device and apparatus described with reference to FIGS. 1-6:

A drum 80 of a centrifuging device 81 contains two concentric sets of vessels or cups, i.e. a first set of cups 82 having the same shape and disposed in the same manner as cups 17 in the device shown in FIGS. 1-5, and a second set of cups 83 distributed in a cylindrical ring having the same axis 90 as drum 80 and inside the cylinder bounded by the set of cups 82. The total number of cups 83 is equal to the number of cups 82, so that each "outer" cup 82 corresponds to an "inner " cup 83. The axes of each pair of corresponding cups are on the same (imaginary) radial line 82*a*.

Cups 83 are also similar in construction to the cups 17 in the previously-described embodiment. However, the bottom apex of each cup 83 has an aperture 84 which, in the radial direction, faces the main aperture of the corresponding cup 82.

The dimensions of aperture 84 are made such that if drum 80 is not rotating around its axis or is rotating at low speed, the liquids in cup 83 cannot flow out through aperture 84, either through gravity or because of the centrifugal force (when the drum is rotating at low speed). As in the embodiment described with reference to FIGS. 1-6, cups 82 and 83 are designed so that the surface tension when the cups are at rest is such that the liquids therein cannot escape through any apertures, irrespective of the position of the cups.

The sets of cups 82, 83 are formed in flexible plates 85, 86 respectively, which are held in the position shown in FIG. 8 (i.e. forming portions of cylinders bounded by generatrices) by inserting their longitudinal edges into grooves 87, 88 in sectional members 89 (FIG. 8) extending longitudinally in the direction of axis 90. Each sectional member 89 is a rail having a web which is radially disposed in drum 80, and the apex of the rail (i.e. its innermost end in the drum) has grooves 88 and 88*a* parallel to axis 90, one on each side of its web. Half-way along, the web of sectional member 89 has grooves 87 and 87*a*.

Plates 86 have a width equal to or slightly less than that of plates 85.

The set of sectional members 89 is secured to a single plate 91 (FIG. 7) which extends transversely with respect to axis 90 and is disposed inside drum 80 near its end plate 92.

The inner surface of the base 93 of each sectional member or rail 89 has a groove 94 (FIG. 9) extending parallel to axis 90. The grooves 94 are adapted to cover balls 95 disposed in recesses 96 in the inner surface of drum 80. The balls are distributed along cylinder generatrices forming drum 80 and facilitate the insertion or removal of the assembly comprising rails 89, plate 91 and cups 82 and 83.

Around axis 90, plate 91 has a recess 100 (FIG. 7). The recess is cylindrical about axis 90 and is open towards plate 92. An iron component 102 is secured to the bottom 101 of recess 100 and is surrounded by a spiral spring 103 which projects beyond the outer surface 91*a* of plate 91 towards plate 92.

Component 102 normally cooperates with an electromagnet 104 secured to the inner surface 92*a* of plate 92 of drum 80, opposite the component 102.

The winding 105 of magnet 104 is supplied with electrical energy via two circular conductors 106, 107 secured to the transverse outer surface 92*b* of plate 92. The conductors are centred on axis 90, and stationary brushes 108, 109 respectively, connected to a current source (not shown), are applied to the conductors.

The power source supplying brushes 108, 109 generates a periodic current having a frequency of the order of a few hertz (10 in the example).

Alternatively, the assembly comprising the electromagnet 104 and the magnetic component 102 can be replaced by an electromagnet having a plunger core.

The aforementioned components (i.e. the source of periodic current, the electromagnet 104, the magnetizable component 102 and the spring 103) can be used to produce longitudinal vibrations along axis 90 in plate 91 and therefore in the set of vessels 82 and 83. In the example, the frequency and intensity of the periodic current can be varied. The current can be modified in a range such that the amplitude of the longitudinal vibrations produced in plate 91 is between 1 and 3 mm. The frequency is variable between 1 and 20 Hz.

Spring 103 is disposed so as to be compressed when coil 105 is supplied with electric current. The energy stored by spring 103 returns plate 91 to its initial position when the current returns to zero.

By means of the two concentric sets of cups 82 and 83, a liquid such as a reagent can be inserted simultaneously and in a very short time into all cups 82. The reason is that, if cups 83 have previously been filled by a reagent of the aforementioned kind and if drum 80 rotates at high speed for centrifuging, the liquids in cup 83 are immediately transferred by centrifugal force through apertures 84 into the corresponding cups 82. In practice, the transfer occurs during the very first revolutions after the drum has been rotated at sufficiently high speed.

The device of FIG. 7 also comprises means whereby some plates holding cups 82 are automatically moved longitudinally, parallel to axis 90, with respect to the plates holding cups 83 without withdrawing the plates from the drum. By means of this feature, at least one cup 82 can be rapidly placed in the path of the light beam (emitted by source 160 in the optical analysis device) during centrifuging.

To this end, plate 91 of the device shown in FIG. 7 has an aperture 110 having its axis parallel to axis 90 and level, in the radial direction, with a plate holding cup 82. A rod 111 can move in the aperture parallel to axis 90 and in a second aperture 112 having the same diameter and coaxial with aperture 110 and formed in the end wall 92 of drum 80. Rod 111 also extends through a projection 113 in wall 92 at the same level. Outside the drum, rod 111 has a milled head 114. The part of rod 111 outside the drum is surrounded by a spiral spring 115 having one end secured to the base of head 114 and the other end secured to the outer surface **92*b* of end 92**.

Rod 111 also has a notch 116 for receiving the end of a rod 117 inserted radially into a radial orifice 118 in projection 113. On the side facing plate 91, rod 117 has a projection 119 having a slope 120 adapted to cooperate with the end of an axial rod 121 inserted into an orifice 122 having its axis parallel to axis 90. Rod 121 extends beyond projection 113 and has a head 123. The part of rod 121 outside orifice 122 is surrounded by a spiral spring 124, the first end of which is secured to the base of head 123 whereas its second end is secured to the transverse surface of the projection 113 into which orifice 122 opens.

The free end of a leaf spring 125 is disposed opposite that opening of orifice 118 which is nearer axis 90. The other end of spring 125 are secured to recess 113.

An assembly 130 identical with the previously-described assembly (i.e. comprising projection 113, rod 111, etc.) is disposed in a diametrically opposite position to avoid vibrating the drum 80 during its rotation.

As a variant, the movable rod 110 for moving the plate holding cups 82 is replaced by a stationary rod (not shown) which, like rod 111 in FIG. 7, projects from the end plate 92 of drum 80 and cooperates with an orifice in plate 91. As soon as electromagnet 104 attracts plate 91, the stationary rod pushes back the plate holding cups 82 since, in its normal position, the end of the rod is practically in contact with the edge of the plate holding cups 82.

The device described with reference to FIGS. 7–9 operates in similar manner to that shown in FIGS. 1–5, but the following points should be noted:

The vibrating means cannot be used until after the contents of cups 83 has been transferred to cups 82. The sets of cups 82 and 83 should be longitudinally vibrated when the drum is rotating sufficiently fast for the centrifugal force to hold the liquid in cups 82.

In the case where the device in FIGS. 7–9 is used for the purpose described previously in the case of the apparatus in FIGS. 1–6, i.e. for determining the rhesus group of a sample of human blood, erythrocytes are first introduced into cups 83 after being incubated in the presence of an anti-D human test serum containing type G immunoglobulins (IgG) and subsequently washed. Drum 80 is rotated at high speed so that the contents of cups 83 is automatically transferred to cups 82. Next, a diluted animal serum or "anti-globulin" is ejected into cups 83 and contains inter alia molecules having an antibody activity with regard to (a) the human IgG immunoglobulins having anti-D antibody specificity with which the erythrocytes have previously been incubated, and (b) the human IgG immunoglobulins fixed to the bottoms of cups 82. After injection, the dilute anti-globulin is transferred to cups 82 in a fraction of a second, during the first revolution after drum 80 has been rotated at high speed.

In an advantageous variant, the erythrocytes are incubated with the dilute antiglobulin in cups 83 after reacting with the anti-D IgG molecules.

The means for longitudinally moving the plate holding cups 82 operate as follows:

Before the plates holding cups 82 and 83 have been inserted into drum 80, rod 111 is disposed in the position shown in continuous lines in FIG. 7 and does not project from plate 91. In this position, spring 115 is stretched and exerts a return force in the direction of arrow $f_1$, i.e. in the direction tending to push rod 111 towards the interior of the drum. The rod is held in the position shown because the end of rod 117 is inserted into notch 116. If rod 111 is not in the position shown in the drawing, it is only necessary to pull it, acting on rod 114, in the opposite direction from arrow $f_1$ until the end of rod 117 is driven into notch 116 by the action of spring 125.

When the vibrating means are not in operation, rod 121 is at a distance from slope 120. However, as soon as the vibrating means are in operation, plate 91 moves in the opposite direction from arrow $f_1$ and comes in contact with head 123 of rod 121, which it moves against the action of spring 124 against slope 120. Under these conditions, rod 117 moves radially and its end comes out of notch 116. The result, owing to the action of spring 115, is that rod 111 moves in the direction of arrow $f_1$ and consequently the plate holding cups 82 at the level of aperture 110 moves in the same direction. As a result, the plate has an end 131 (shown in broken lines) which projects beyond the exterior of the drum and presents a cup for optical analysis.

Optical analysis during centrifuging is for the purpose of controlling the duration and rate of centrifuging to ensure optimum conditions for the reaction in cups 82. This is done e.g. by comparing the surface of a micro-deposit formed in the cup "observed" by the analysis device with the surface of a micro-deposit in a reference reaction after the rate of growth of the surface of the deposit has been previously recorded.

Figure 10:
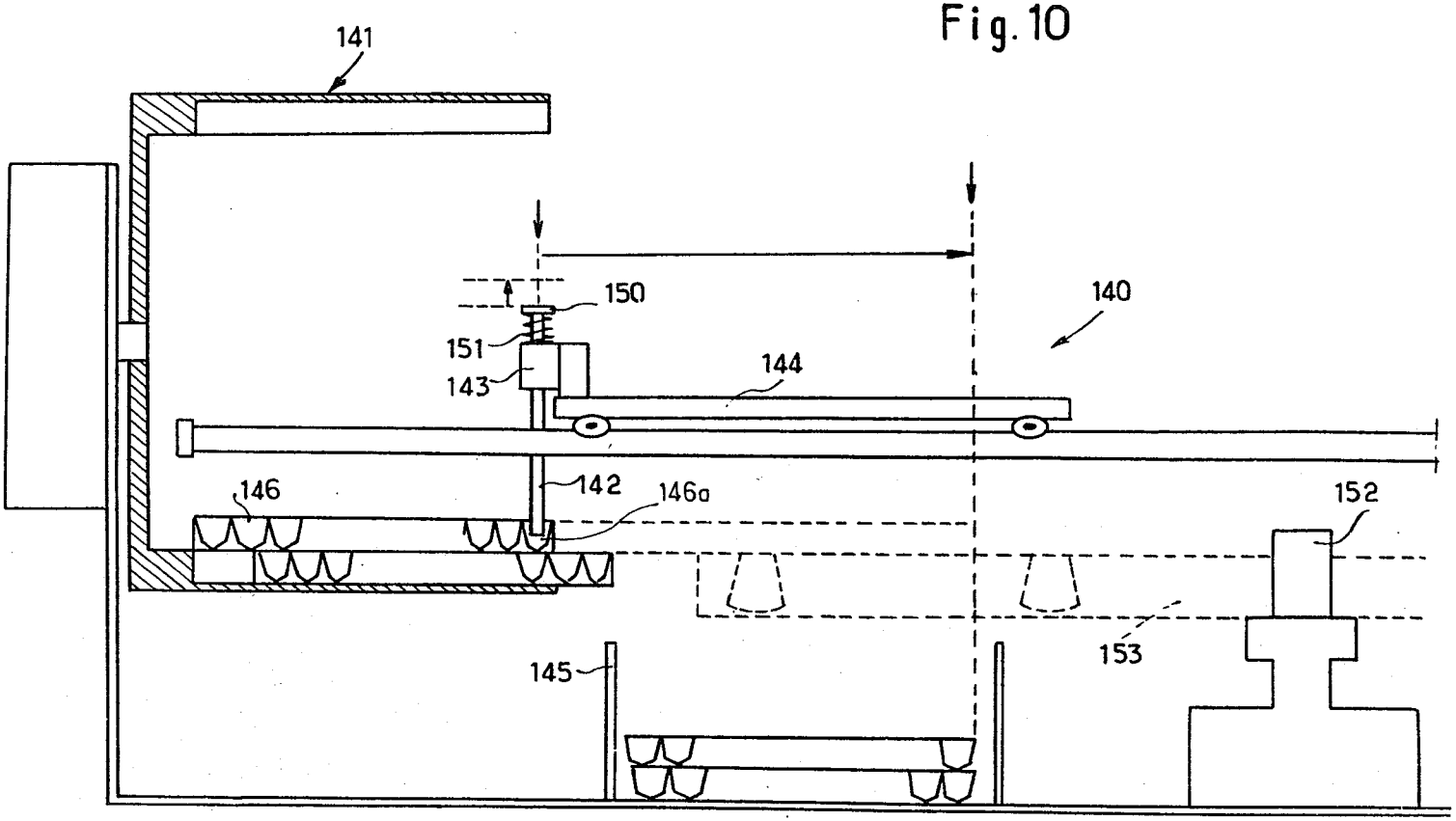
FIG. 10 is a view corresponding to FIG. 1 but more diagrammatic, illustrating another embodiment of the device for analysing sets of liquid samples according to the invention.

In order to make the final optical analysis, cups 83 have to be extracted from drum 80 after centrifuging. Extraction can be manual or automatic. FIG. 10 shows an embodiment of a device for automatically extracting plates from drum 80. In the example, a slide 140 is used and corresponds to the slide 5 in the device shown in FIGS. 1–6. A rod 142 is suspended vertically from the front end of slide 140, i.e. the end facing the centrifuge 141. Rod 142 can move vertically under the action of an electromagnet 143 secured to the front part of the platform or surface 144 of the slide. Accordingly, rod 142 extends through magnet 143 and its top part is secured to a magnetic component 150. The part of rod 142 between component 150 and the body of magnet 143 is surrounded by a spring 151.

A receptacle 145 for holding plates 146 similar to the plates holding cups 83 in the device shown in FIGS. 7 and 8 is disposed near the aperture of drum 141 (i.e. near in the axial direction) and outside the drum. The receptacle is below the drum aperture.

A disc 153 similar to disc 3 (FIG. 1) has a removable shaft 152, so that disc 153 can be taken out of its holder by moving it parallel to the axis of drum 141 so that the plates 146 extracted from drum 141 can be dropped into receptacle 145.

In a variant (not shown) the electromagnet is replaced by mechanical ratchet-type extractor means for extracting the plates holding cups 83.

The device in FIG. 10 operates in similar manner to the device described with reference to FIGS. 1–6 and 7–9, but differs in the following points:

During centrifuging in drum 141, disc 153 is withdrawn, e.g. manually, from the position which is occupied (shown in broken lines) by removing shaft 152.

After centrifuging and before optical analysis, plates 146 are discharged into receptacle 145 by switching on the extraction device. To this end, platform 144 is moved forward as shown in FIG. 10 and rod 142 is disposed opposite the cup 146*a* on the plate 146 which is nearest the aperture 141. Next, after the coil of electromagnet 143 has been energized, rod 142 is lowered into the cup in question and the slide is moved backwards, i.e. away from drum 141, so that plate 146 is moved out of the drum and falls into receptacle 145. After magnet 143 is switched off, rod 142 is raised by the action of spring 151.

Plates 146 are extracted one by one by stepwise rotation of drum 141.

The device according to the invention is suitable for numerous applications. It is of use in general for processing or analyzing a set of liquid samples by centrifuging them.

I claim:

1. A device for centrifuging liquid, comprising a vessel having an orifice and adapted to hold the liquid to be centrifuged, and means for rotating the vessel around an axis of rotation of the device, said vessel having a shape chosen and being made of a material chosen so as to create, in the absence of rotation of the device, forces of attraction between the liquid and the vessel which prevent the liquid from escaping from the vessel irrespective of the position of the latter, the axis of rotation of said vessel being horizontal, the orifice of said vessel facing said axis of rotation.

2. A device for centrifuging liquid, comprising a vessel having an orifice and adapted to hold the liquid to be centrifuged, and means for rotating the vessel around an axis of rotation of the device, said vessel having a shape chosen and being made of a material chosen so as to create, in the absence of rotation of the device, forces of attraction between the liquid and the vessel which prevent the liquid from escaping from the vessel irrespective of the position of the latter, even if the axis of rotation of the device is horizontal and the orifice of the vessel faces downwards, said device comprising a set of vessels each adapted to contain a liquid sample and borne by a drum adapted to be driven in rotation around its axis, the vessel orifices facing the axis and the vessels themselves having an axis substantially perpendicular to the axis of rotation.

3. A device according to claim 2, wherein the vessels are divided into groups each containing the same number of vessels, the edges of the apertures of the vessels in each group being secured to a flexible plate having at least two parallel edges separated by a given distance, and the drum has sectional members secured to its inner wall, extending parallel to its axis, regularly distributed around the axis and forming means for receiving the edges of flexible plates such that, when a flexible plate is thus disposed between two adjacent sectional members, the bottoms of the vessels secured to the plate are pressed against the inner wall of the drum.

4. A device according to claim 3, wherein the vessels and the flexible plates are in one piece.

5. A device according to claim 2, wherein the vessels have a conical bottom and are adapted to be disposed in the drum so that the axis of the bottom is radial with respect to the drum axis.

6. A device according to claim 2, wherein said drum has an aperture for inserting and extracting vessels along its first lateral end and its end opposite said aperture is secured to the shaft of a motor forming part of the means for driving the drum in rotation.

7. A device according to claim 2, wherein the vessels are adapted to be disposed in the drum along lines parallel to the drum axis and at regular intervals around the axis.

8. A device for analysing and/or processing sets of liquid samples divided among vessels secured to a ring on a disc adapted to rotate around its axis, each set being made up of a number n of samples disposed in a number n of vessels, the axes of which are disposed on an involute of a circle, said device comprising a centrifuging means according to claim 7, wherein the number of vessels along a line parallel to the axis of the drum in the device is at least equal to the number n, means being provided whereby the n samples disposed in the vessels having axes distributed along an involute of a circle are simultaneously transferred to n corresponding vessels in the drum in the centrifuging device, the axes of the last-mentioned vessels being along a line parallel to the drum axis.

9. A device according to claim 8, wherein transfer means comprise a number n of probes or hollow needles, suction and delivery means for each hollow needle, means for raising and lowering the needles together, means for moving the needles in the ring towards the drum interior and vice versa, means for modifying the distribution of the ends of the hollow needles so as to change over from a distribution along a curve (inter alia the involute of a circle) to a distribution along a straight line when the needles are moved from the ring towards the interior of the drum of the centrifuge device or vice versa, means for rotating the drum stepwise around its axis, each step corresponding to the space between each two lines of n vessels on the drum, and means for rotating the disc stepwise around its axis.

10. A device according to claim 9, wherein means for raising and lowering the set of needles and the means for moving the needles from the ring to the drum interior and vice versa comprise a chain or belt, means for rotating the chain or belt along a given path having a horizontal part and a vertical part, and a means for driving the set of needles and secured to a part of the chain or belt so as to move through the horizontal or vertical parts, the driving means travelling over the horizontal or vertical sections depending on whether the needles are moved from the ring to the drum or vice versa, or the needles are moved vertically.

11. A device according to claim 9, wherein means for modifying the distribution of the ends of the hollow needles comprise at least one sector pivoting around a vertical axis, the sector being secured to a hollow needle, and means for pivoting the sector between two given positions corresponding to the aforementioned distributions.

12. A device according to claim 8, wherein the transfer means comprise a slide secured to means for optically analyzing the samples after reaction, the samples being disposed in the vessels in the centrifuging device, the optical analysis means comprising a light source and a detecting means, both disposed on holders at a distance from one another so that, when the slide is introduced, at least partly, into the drum, one holder is inside the drum and the other holder is outside, the two being separated by a vessel in the drum, the bottoms of the vessels being transparent and the drum having transparent parts corresponding to the bottoms of the vessels.

13. A device according to claim 12, wherein detecting means comprises an image-analysing tube associated with electronic means for scanning images in two dimensions.

14. A device according to claim 12, wherein the light source emits a diffused beam having a cross-section substantially greater than that of each vessel on the drum.

15. A device according to claim 12, wherein said centrifuging means comprises a second set of vessels, the number being equal to the first set, the vessel bottoms being formed with apertures, and the vessels of this second set are adapted to hold a liquid and are shaped and made of material such that, in the absence of rotation, surface tension forces and/or electrostatic forces of attraction between the liquid and the vessels prevent the liquid from escaping from the vessel, irrespective of its position, and means are provided for ensuring that the second set of vessels has an invariable position relative to the first set, each vessel in the second set being associated with a vessel in the first set and being on the same radial line as the latter but nearer the axis of rotation, so that its perforated bottom, in the radial direction, is opposite the aperture of the corresponding vessel in the first set so that the contents of the vessels in the second set can be transferred by centrifuging to the vessels in the first set, and means for automatically extracting the second set of vessels from the drum after the contents of the vessels in the second set have been transferred to the vessels in the first set and after the contents of the vessels in the first set have been processed.

16. A device according to claim 2, wherein the bottoms of the vessels are transparent and the drum has transparent parts or apertures at the places corresponding to the bottoms of the vessels.

17. A device according to claim 2, comprising a second set of vessels, the number being equal to the first set, the vessel bottoms being formed with apertures, and the vessels of this second set are adapted to hold a liquid and are shaped and made of material such that, in the absence of rotation, surface tension forces and/or electrostatic forces of attraction between the liquid and the vessels prevent the liquid from escaping from the vessel, irrespective of its position, and means are provided for ensuring that the second set of vessels has an invariable position relative to the first set, each vessel in the second set being associated with a vessel in the first set and being on the same radial line as the latter but nearer the axis of rotation, so that its perforated bottom, in the radial direction, is opposite the aperture of the corresponding vessel in the first set so that the contents of the vessels in the second set can be transferred by centrifuging to the vessels in the first set.

18. A device according to claim 17 wherein the vessels of the first set are divided into groups each containing the same number of vessels, the edges of the apertures of the vessels in each group being secured to a flexible plate having at least two parallel edges separated by a given distance, and the drum has sectional members secured to its inner wall, extending parallel to its axis, regularly distributed around the axis and forming means for receiving the edges of flexible plates such that, when a flexible plate is thus disposed between two adjacent sectional members, the bottoms of the vessels secured to the plate are pressed against the inner wall of the drum, and the vessels in the second set, like those in the first set, are divided into groups each containing the same number of vessels, the edges of the apertures of the vessels in each group being secured to a second flexible plate having at least two parallel edges separated by a given distance, which preferably is slightly less than the given distance between two parallel edges of the first flexible plate, and the sectional members secured to the inner wall of the drum have second means for receiving the edges of the second flexible plates, the second receiving means being disposed between the axis of rotation and the first receiving means so that the flexible plates for the first and second set are disposed in a first and a second concentric cylinder respectively.

19. A device according to claim 18, wherein the sectional members are secured to a single holder such as a plate, independent of the drum, and the base of each sectional member and the inner surface of the drum have complementary guide means so that the sectional members can move in the drum parallel to the axis of rotation.

20. A device according to claim 19, wherein guide means, on the inner surface of the drum, comprises balls disposed in recesses in line along generatrices, and the bottom surface of the base of each sectional member has a longitudinal groove adapted to cover each line of balls.

21. A device according to claim 19, comprising means causing the holder for the sectional members to vibrate longitudinally and parallel to the axis of rotation when the drum rotates.

22. A device according to claim 21, wherein vibrating means comprise electromagnet means and a periodic low-frequency current supply between 1 and 20 Hz.

23. A device according to claim 21, wherein said vibrating means, when they being to operate, actuate means for automatically moving at least one vessel in the first set parallel to the drum axis relative to the vessels in the second set so that a radial light beam travels through the aforementioned vessel in the first set after it has thus been moved, without travelling through the vessel in the second set.

24. A device according to claim 17, comprising means for automatically moving at least one vessel in the first set parallel to the drum axis relative to the vessels in the second set so that a radial light beam travels through the aforementioned vessel in the first set after it has thus been moved, without travelling through the vessel in the second set.

25. A device according to claim 2, comprising two sets of vessels adapted to be disposed so that each vessel in a set corresponds to a vessel in the other set disposed along the same radial line relative to the axis of rotation of the device, all the vessels having an aperture for introducing liquid and facing the axis of rotation, and those vessels in the second group which are nearest the axis of rotation have a perforated bottom facing the insertion aperture of the corresponding vessel in the second set.

26. A device according to claim 22 or claim 25 wherein the axis of rotation is horizontal.

* * * * *